United States Patent [19]

Brandt

[11] 4,122,298

[45] Oct. 24, 1978

[54] OFFSET CONSTANT THICKNESS WEB FOR INSULATOR SUPPORT DISK

[75] Inventor: Thomas F. Brandt, Swarthmore, Pa.

[73] Assignee: Electric Power Research Institute, Palo Alto, Calif.

[21] Appl. No.: 808,709

[22] Filed: Jun. 21, 1977

[51] Int. Cl.[2] ..... H01B 9/04

[52] U.S. Cl. ..... 174/28; 138/112

[58] Field of Search ..... 174/28, 111; 138/108, 138/112, 113, 114

[56] References Cited

U.S. PATENT DOCUMENTS

| | | | |
|---|---|---|---|
| 2,325,616 | 8/1943 | Landweber | 138/112 X |
| 3,789,129 | 1/1974 | Ditscheid | 174/28 |
| 3,996,414 | 12/1976 | Artbauer et al. | 174/16 B |

FOREIGN PATENT DOCUMENTS

| | | | |
|---|---|---|---|
| 1,665,711 | 12/1970 | Fed. Rep. of Germany | 174/28 |
| 1,515,832 | 11/1969 | Fed. Rep. of Germany | 174/28 |

*Primary Examiner*—Arthur T. Grimley

*Attorney, Agent, or Firm*—Ostrolenk, Faber, Gerb & Soffen

[57] ABSTRACT

The support insulator for a flexible gas-insulated transmission line is formed in two halves which can be snapped together and over the central conductor of the transmission line. The insulator halves each contain a central hub region and an outer rim region which are connected to one another by a thin connecting web of uniform thickness. The thin connecting web has axially offset regions which are connected to one another by axially extending side regions. Each of the axially offset regions has a generally pie or wedge shape and substantially increase the stiffness modulus of the insulator structure.

11 Claims, 12 Drawing Figures

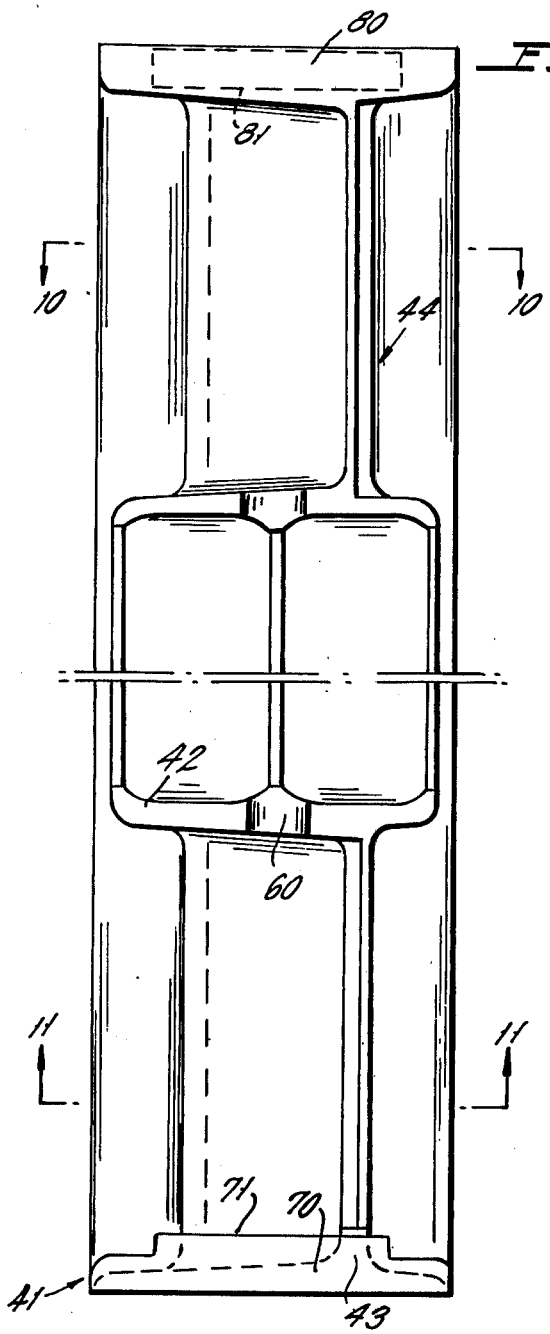
FIG. 4.
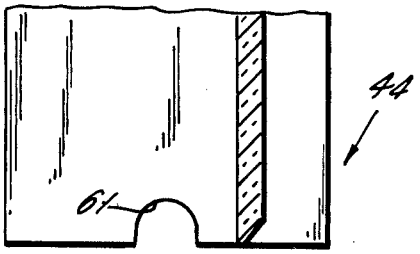
FIG. 10.
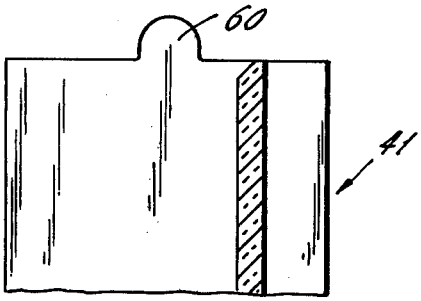
FIG. 11.
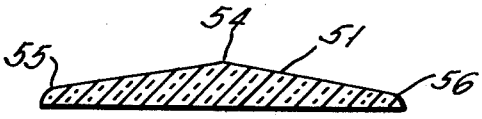
FIG. 12.
FIG. 8.
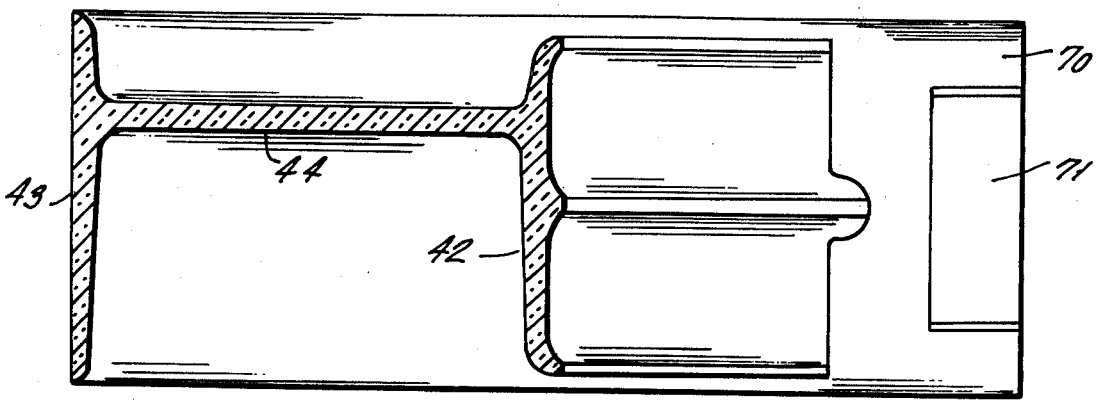

OFFSET CONSTANT THICKNESS WEB FOR INSULATOR SUPPORT DISK

RELATED APPLICATIONS

This application is related to copending applications Ser. No. 734,965, filed Oct. 22, 1976; entitled INSULATION SPACER FOR FLEXIBLE GAS-INSULATED TRANSMISSION LINE, in the name of Philip C. Netzel and Thomas F. Brandt; Ser. No. 808,710, filed June 21, 1977, in the name of Philip C. Netzel entitled LATCH STRUCTURE INSULATOR SPACER; and Ser. No. 808,707, filed June 21, 1977, entitled MULTIPLE PART INSULATOR FOR FLEXIBLE GAS INSULATED TRANSMISSION LINE CABLE, in the names of Philip C. Netzel and Jonathan Z. Ponder.

BACKGROUND OF THE INVENTION

This invention relates to high-voltage gas-insulated power transmission systems, and more specifically relates to a novel support insulator structure for a flexible transmission line system. High-voltage gas-insulated transmission systems are well known to those skilled in the art and are shown, for example, in the above-noted related applications and are also shown in U.S. Pat. No. 3,789,129 in the name of Ditscheid and in U.S. Pat. No. 3,996,414 in the name of Artbeller, et al.

Insulators used in flexible gas cable preferably will have the thinnest possible web section between a central hub which grips the central conductor of the transmission line and the outer rim which grips the interior of the grounded housing of the transmission line. A thin web is desirable in order to prevent excessive dielectric stress in the insulator. It is also necessary, however, that the web has sufficient strength to support the central conductor within the grounded housing, and to withstand the mechanical stresses created during flexing of the flexible transmission line system. This web strength in the past has been obtained either by increasing the web thickness or by providing reinforcing ribs in the web. Reinforcing ribs are difficult to form and frequently will become the source of voids in the molded insulator. The greater thickness web creates dielectric problems for the support insulator.

BRIEF DESCRIPTION OF THE PRESENT INVENTION

In accordance with the present invention, a novel web configuration is provided wherein the web consists of a plurality of axially offset regions which lie in respective spaced parallel planes and which are joined by connecting sections which lie at an angle relative to the central plane of the insulator. All of the offset web sections are of a constant thickness which can be relatively thin and the configuration of the offset web sections imparts substantial stiffness to the insulator structure. In fact, the stiffness modulus is increased about 30–40 times over that of a web construction which lies in a single plane extending from the central hub to the outer insulator. The precise offset to be used and the sector angle which is used for each of the offset sections will depend on the details of the insulator design, the configuration of the conductor corrugations, and molding limitations. Moreover, the use of a constant web thickness improves the ability of the insulator to be formed by molding.

BRIEF DESCRIPTION OF THE DRAWINGS

FIG. 4 is a plan view of the end surface of one half of the insulator of FIG. 3.

FIG. 8 is a cross-sectional view of FIG. 5 taken across the section line 8—8 in FIG. 5.

FIG. 10 is a cross-sectional view of FIG. 4 taken across the section line 10—10 in FIG. 4.

FIG. 11 is a cross-sectional view of FIG. 4 taken across the section line 11—11 in FIG. 4.

FIG. 12 is a cross-sectional view of FIG. 6 taken across the section line 12—12 in FIG. 6.

DETAILED DESCRIPTION OF THE DRAWINGS

Figure 1:
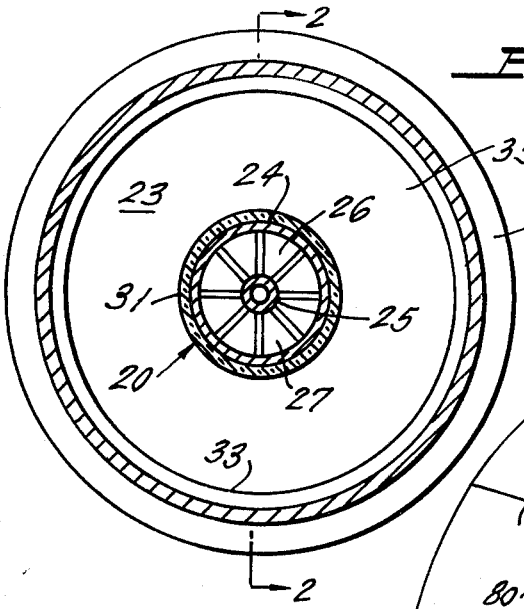
FIG. 1 is a cross-sectional view of a corrugated transmission line which can employ the support insulator of the present invention and is a cross-sectional view of FIG. 2 taken across section line 1—1 in FIG. 2.
Figure 2:
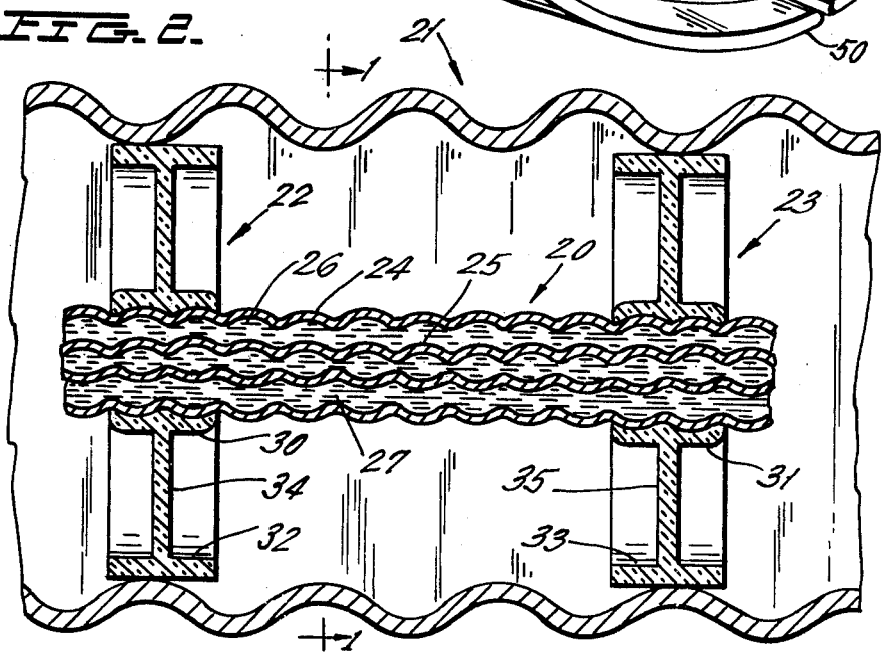
FIG. 2 is a cross-sectional view of FIG. 1 taken across the section line 2—2 in FIG. 1, and illustrates a prior art type of support insulator.

Referring first to FIGS. 1 and 2, there is shown a section of typical flexible gas-insulated transmission line for conducting electric power at low frequency, for example, 60 Hz., and at high voltage, for example, 230,000 volts. The transmission line consists of a central flexible conductor 20, an outer flexible grounded housing 21, and spaced support insulators 22 and 23 which support conductor 20 within housing 21.

The central conductor 20 can be constructed in any desired manner, and is shown as consisting of concentric corrugated copper tubes 24 and 25 which support segmented groups of conductive strands between them, including typical groups 26 and 27. The effective cross-sectional area of central conductor 20 is 3600 square millimeters, and conductor 24 has an outer diameter of about 100 millimeters.

Outer conductor 21 consists of a corrugated aluminum tube having an outer diameter of about 300 millimeters. Conductor 21 is formed by wrapping sheet material around insulators 22 and 23 formed on conductor 20, and is then welded on a longitudinal weld seam. The tube is then corrugated with corrugations which are parallel to one another and perpendicular to the axis of tube 21, or with corrugations which are threaded around the axis of tube 21. The corrugations may have a depth of about one inch, and a crest-to-crest spacing of about two inches.

The support insulators 22 and 23 are only schematically shown in FIGS. 1 and 2 and each consists of inner and outer rims 30, 31 and 32, 33, respectively, joined by thin transverse webs 34 and 35, respectively. The construction of the insulators 22 and 23 is the subject of the present invention and will be described in detail in connection with FIGS. 3 to 13.

The interior of housing 21 is filled with clean sulfur hexafluoride at a pressure of about 45 p.s.i.g. at room temperature, and the assembly is provided with terminals at either end and is sealed.

The assembly of FIGS. 1 and 2 can have any desired length and may be reeled on a 3.7 meter diameter reel for shipment to an installation site.

Figure 3:
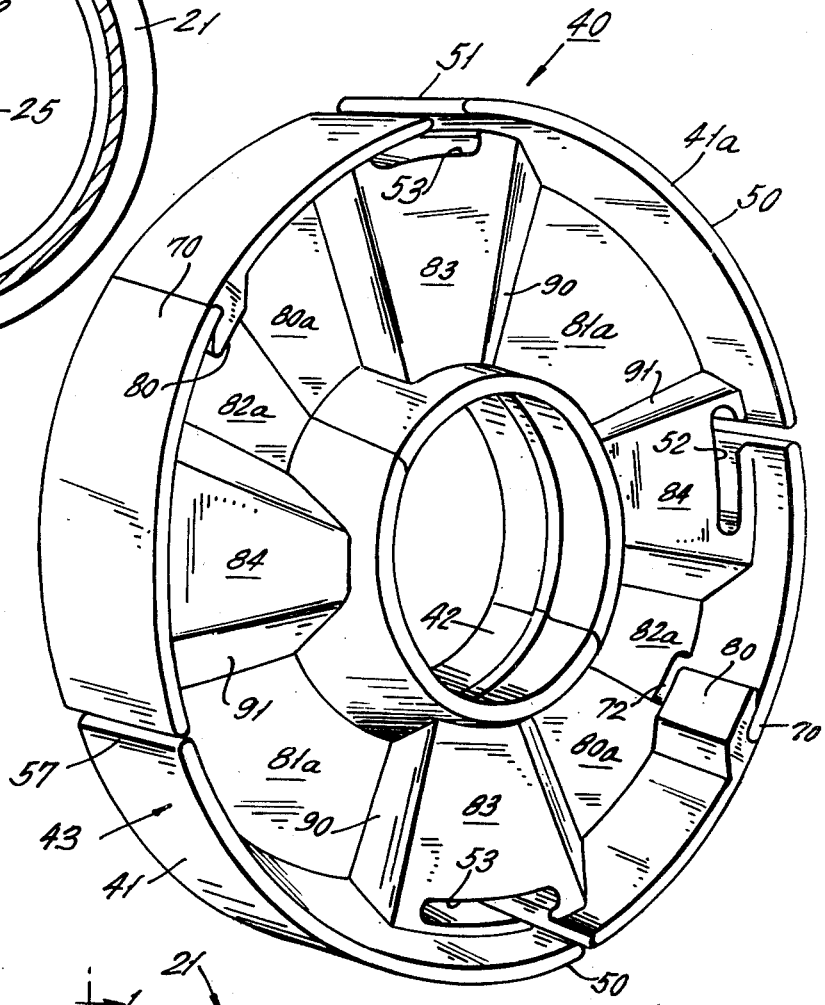
FIG. 3 is a perspective view of the two halves of a novel insulator constructed in accordance with the present invention when the halves are snapped together.

FIG. 3 is a perspective view of an insulator 40 which is constructed in accordance with the present invention wherein the insulator 40 is made of two halves 41 and 41*a*, which are identical to one another. Halves 41 and 41*a* can be snapped over the central conductor of a transmission line, such as the conductor 24 in FIGS. 1 and 2, to serve the function of one of the insulators 22 or 23 in FIG. 2.

FIGS. 4 to 12 show the details of the construction of one of the halves 41 of the insulator of FIG. 3. Thus, the insulator half 41 consists of an inner hub 42 which has an interior surface shape adapted to follow the corrugation of the central conductor of the gas-insulated transmission system so that the inner hub section will nest within the troughs of the outer corrugated section of the central conductor. The insulator half 41 is also provided with an outer rim 43 which fits within the interior of the outer conductive housing 21 of the gas-insulated transmission line as shown in FIGS. 1 and 2. The outer rim 43 is fixed to the inner hub 42 by a support web 44, which is of offset configuration, as will be later described, in order to increase the mechanical strength of the insulator.

The outer rim 43 of insulator 41 is provided with two spring-like sections 50 and 51 which are formed by transverse cuts through rim 43, and by slotting the web 44 with slots 52 and 53, respectively, which communicate with the cuts in rim 43. Sections 50 and 51 of the rim 43 project beyond the outer circumference of the rim 43 when unstressed. They have a cross-section thicker at the center than at the outer ends, as shown in FIG. 12, from member 51 to increase their spring constant. Thus, as shown in FIG. 12, the center region 54 of rim 51 is thicker than the edge regions 55 and 56. Sections 51 and 52 serve as springs which are securely gripped by the interior diameter of the outer conductive housing 21 of FIGS. 1 and 2 to help retain the insulator in its proper location.

In order to center the hub 42 of half 41 with respect to the cooperating hub of the half 41*a* in FIG. 3, one side of the face of the hub half is provided with a projecting key section 60, which is seen in FIGS. 4, 5, 6 and 11, while the opposite side of the face of hub 42 has a keying depression 61 as seen in FIGS. 4 and 10. When the two hubs of the two cooperating halves 41 and 41*a* are to be assembled, the keying projection 60 of one enters the keying depression 61 of the other in order to lock the hub sections against relative axial motion with respect to one another after the two insulator halves are latched in place over the central conductor.

Figure 5:
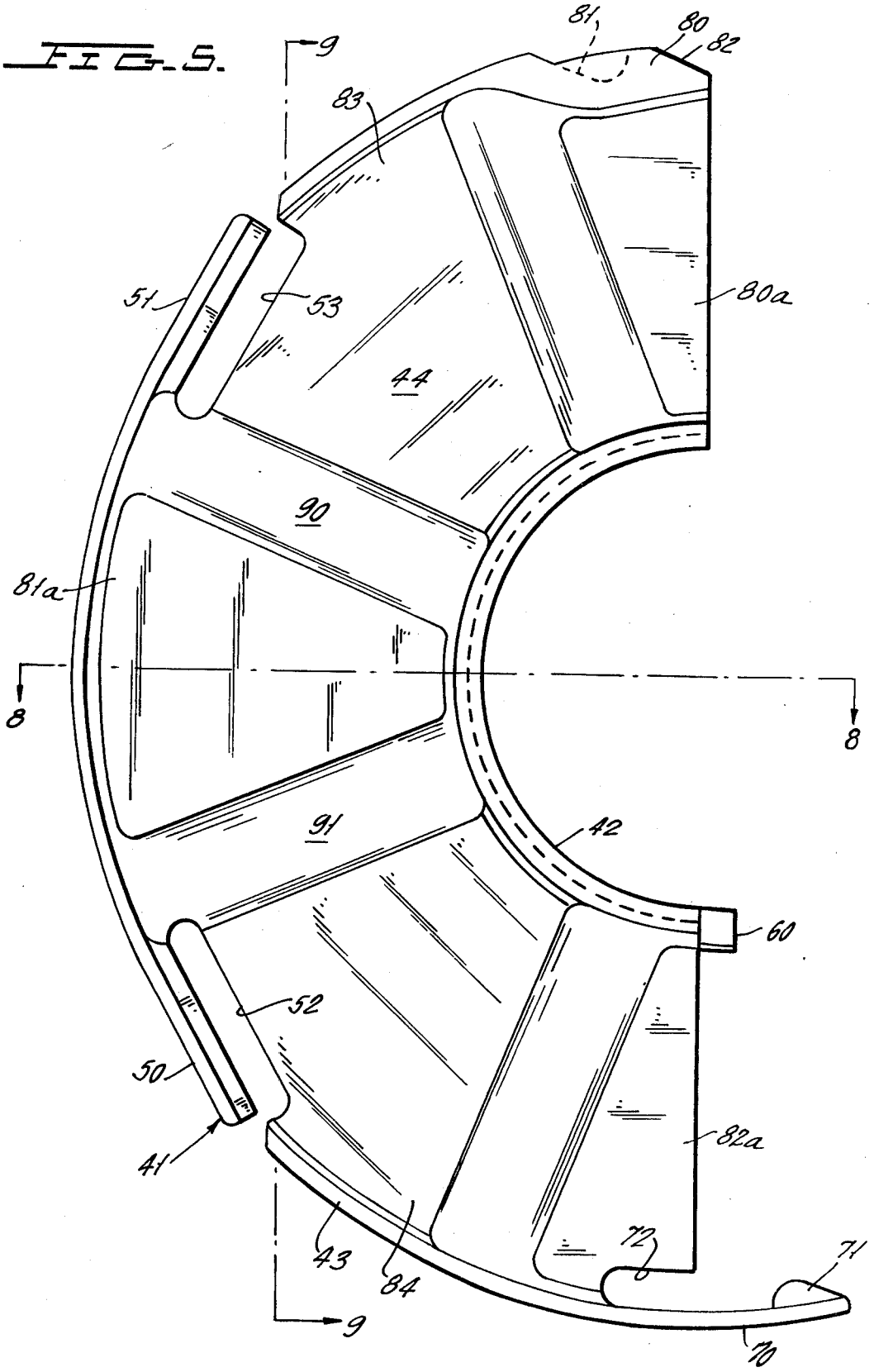
FIG. 5 is a plan view of the left-hand side of the insulator half of FIG. 4.
Figure 6:
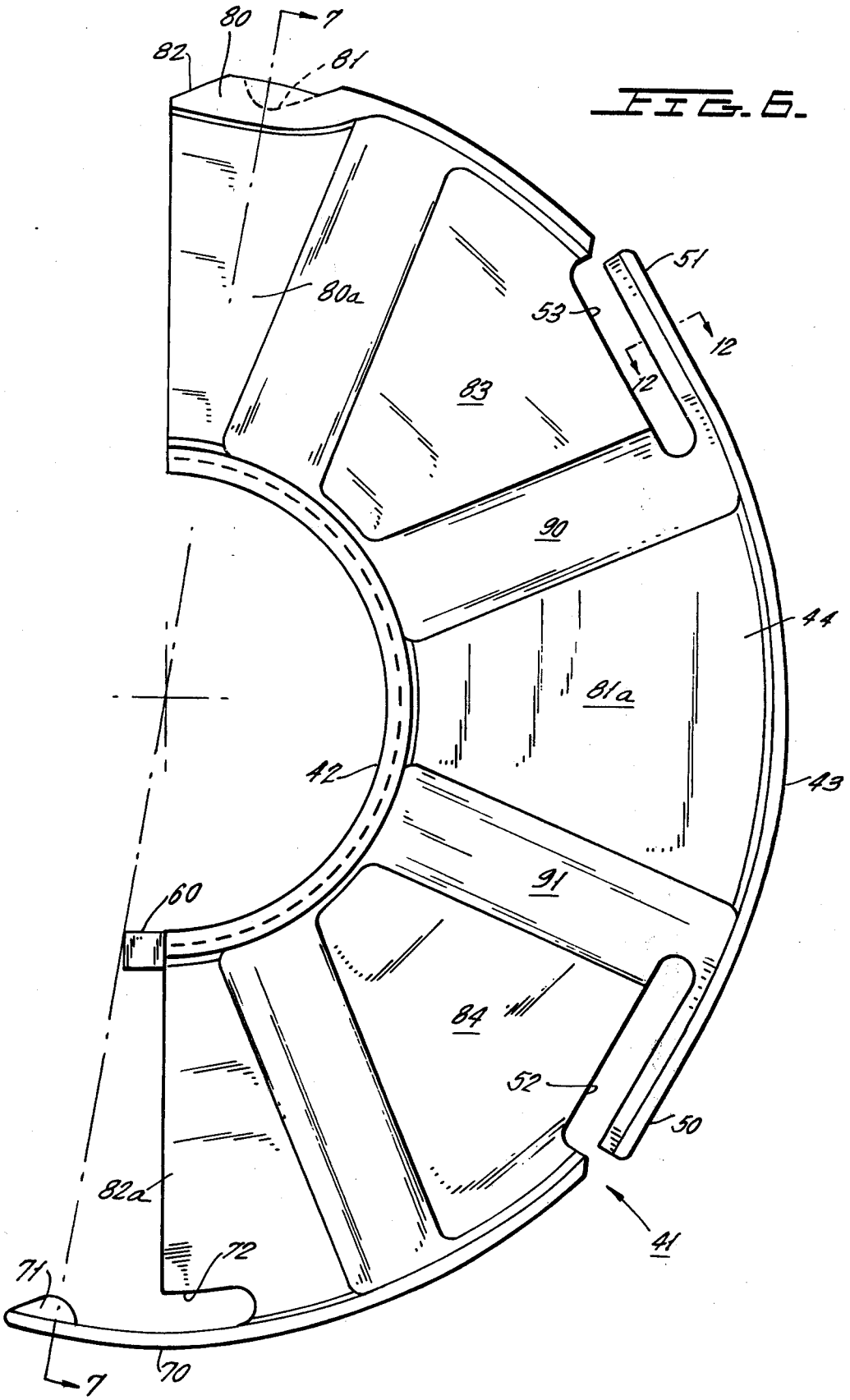
FIG. 6 is a plan view of the right-hand side of the insulator of FIG. 4.

The outer latch structure on the outer rim 43 consists of a flexible central latching projection 70 (that is centrally located on the rim 43) which has a centrally disposed raised latch section 71 as best seen in FIGS. 4, 5, 6, 7 and 8. Projection 70 is made flexible by virtue of a thin slot 72 in the web 44 as shown in FIGS. 5 and 6. The opposite side of the insulator half 41 has a latch-receiving portion 80 which consists of a reinforced rim region having a central latch-receiving depression 81 therein as best shown in FIGS. 4 to 7. The latch-receiving depression 81 is contoured to cooperate in shape with the latch structure 71 on the opposite end of the half 41. In addition, the portion 80 is provided with a camming surface 82 leading to the latch depression 81. Thus, when two halves 41 and 41*a* of the insulator are to be snapped together, each latch-raised section 71 will be cammed up each ramp section 82 and then will snap into depression 81 in order to lock the opposite halves of the two insulator halves together.

When the halves are completely latched, the keying members 60 will also be disposed in their keying projections 61. It will be noted that the latch member 71 fits securely within the side-to-side confines of latch-receiving depression 81 and thus the outer rim 43 will be fixed in axial position at the region where the two insulator halves are latched together.

It will also be noted that, since the latched member 70 completely overlies the latch member 80 over the full width of rim 43 when two insulator halves are brought together, there will be no line-of-sight from the central hub 42 of the insulator, where the central conductor is contained, to the outer conductive housing which surrounds the outer rim 43. Thus, the insulator of the present invention provides improved creepage distance between the central conductor and the outer grounded housing in the gas-insulated transmission system.

The web 44 which joins the hub 42 to the outer rim 43 is provided with several offsets in order to increase the web strength while still using a relatively thin section for the web. Thus, when molding insulators, it has been found the use of heavy web sections tends to create voids in the web which is deleterious to the dielectric performance of the insulator. Moreover, relatively thick web sections have a deleterious affect on the dielectric behavior of the insulator.

Figure 7:
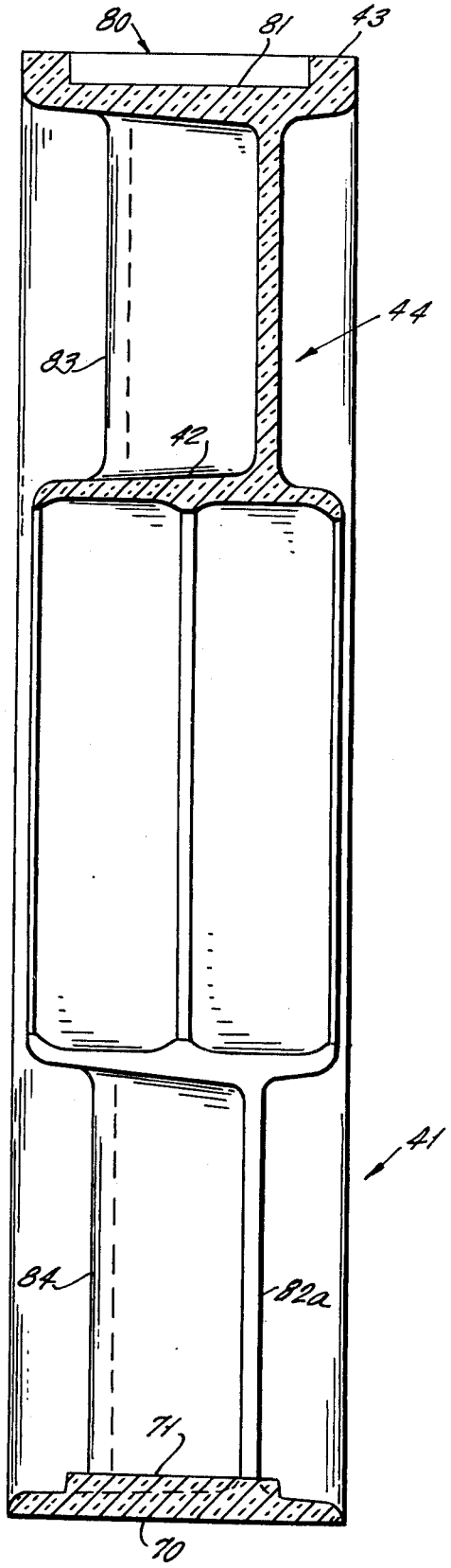
FIG. 7 is a cross-sectional view of FIG. 6 taken across the section line 7—7 in FIG. 6.

The arrangement shown in FIGS. 3 to 12 permits the use of a constant thickness, thin web section without requiring enlarged ribs for strengthening the web section. Thus, the web has several offsets in its axial direction on either side of a plane through the axial center of the insulator. These offset sections are shown in FIGS. 5 to 9. As seen in FIGS. 6 and 7, the web portions 80*a*, 81*a* and 82*a* lie to the right of the axial center of the insulator half 41 while the web regions 83 and 84 lie to the left of the axial center of the insulator half 41. The staggered web regions 80*a*, 81*a*, 82*a*, 83 and 84 are joined by suitable wall sections which extend at an angle to the plane of the insulator 41–41*a*. By way of example, the drawings show three sections 80*a*, 81*a* and 82*a* in a common plane which is spaced from the common plane containing sections 83 and 84 by about 1 inch. Note further that the sections 80*a*, 81*a*, 82*a*, 83 and 84 may be generally pie-shaped as shown. Any desired number of sections could have been chosen. It has been found that, when this configuration is used, a constant web thickness, for example, 4 millimeters, may be used for the web 44.

Figure 9:
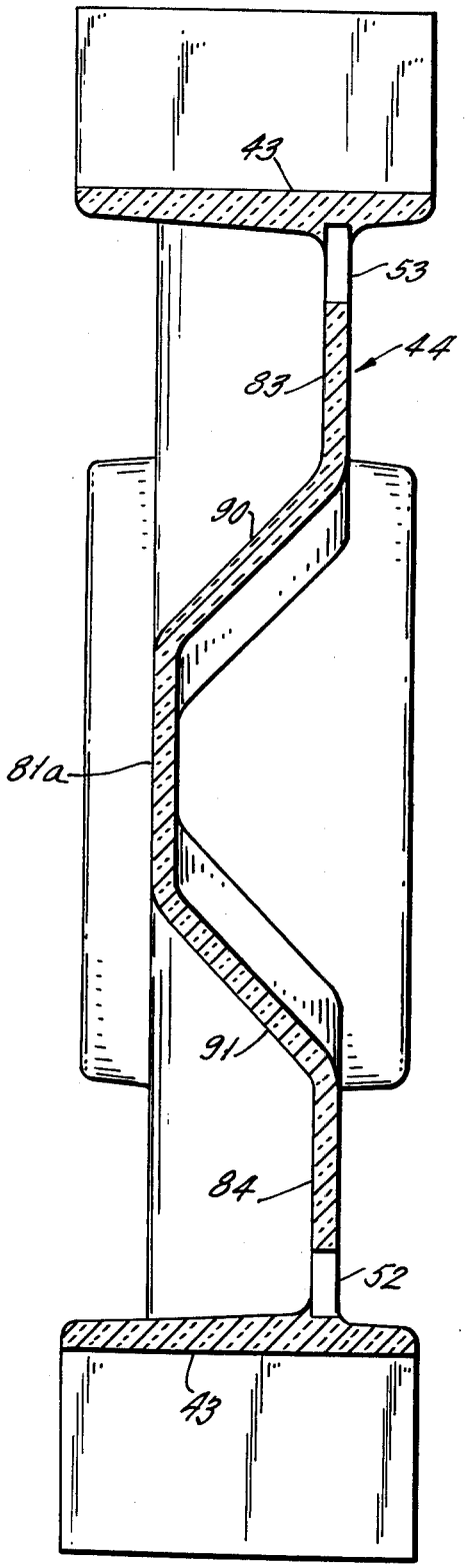
FIG. 9 is a cross-sectionalview of FIG. 5 taken across the section line 9—9 in FIG. 5.

FIG. 9 shows two sections 90 and 91 which join web portions 83 and 84 to the web sections 81*a* and 82*a*, respectively. It can be seen that connecting portions 90 and 91 have components in both the axial direction and radial direction of the plane of the insulator half, and specifically the interconnecting sections 90 and 91 are at about 45° to the plane of the insulator half. When using this configuration of a relatively thin but constant thickness web with offset regions, it has been found that the stiffness modulus of the insulator is 2 to 3 times the stiffness modulus of the same insulator using a web contained in a single plane.

Clearly, other configurations could be used for the offset web other than the specific offset pattern illustrated, and different numbers of offsets can be used having a different cross-section from that shown.

The insulator material to be used in connection with the insulator body of the present invention may be of any desired type and one insulation material which has been found useful is acrylic plexiglass DR61k. This is a clear material and permits visual inspection of the insulator for flaws created during the molding process.

Although a preferred embodiment of this invention 10 has been described, many variations and modifications will now be apparent to those skilled in the art, and it is therefore preferred that the instant invention be limited not by the specific disclosure herein but only by the appended claims.

The embodiments of the invention in which an exclusive privilege or property is claimed are defined as follows:

1. An insulator support disk for supporting the central conductor of a gas-insulated transmission line within an outer grounded housing which is coextensive with said central conductor; said insulator support disk consisting of at least first and second identical segments which fit over the central conductor of a transmission line and define a continuous disk therearound; each of said segments having a central axially extending rim for gripping a central conductor and an axially extending outer rim for gripping the interior of an outer housing; each of said segments having a central web extending between said outer rim and said central rim; and means for securing said at least first and second segments to one another to define a continuous support disk; said central web for each of said segments having at least first and second flat sections each extending between said central rim and said outer rim; and being displaced relative to one another in the direction of the axis of said disk, thereby to increase the stiffness modulus of said central web.

2. The insulator support disk of claim 1 wherein said central web has a uniform thickness.

3. The insulator support disk of claim 1 wherein said first and second sections have areas which are generally wedge shaped.

4. The insulator support disk of claim 1 wherein said first and second sections are disposed in spaced parallel planes on opposite sides of a plane through the axial center of said insulator support disk; said first and second secions being joined by side sections which are continuous with said sections, and which are disposed at an angle to a plane through said insulator support disk which is through the center of the axis of said disk and is perpendicular thereto.

5. The insulator support disk of claim 4 wherein said central web has a uniform thickness.

6. The insulator support disk of claim 5 wherein said first and second sections are generally wedge shaped.

7. The insulator support disk of claim 1 wherein said disk has an outer diameter of about 300 millimeters and wherein said web has a constant thickness of about 3 to 4 millimeters.

8. The insulator disk of claim 1 wherein said disk consists of two half segments; each of said segments having at least three offset sections, two of which are coplanar, and the third is disposed between said coplanar two sections and is in a plane which is axially spaced from the plane of said two coplanar sections.

9. The insulator support disk of claim 1 wherein adjacent sections of said at least three offset sections are joined by continuous side sections which are disposed at an angle to a plane through said insulator support disk which is through the center of the axis of said disk and is perpendicular thereto.

10. The insulator support disk of claim 9 wherein said central web has a uniform thickness.

11. The insulator support disk of claim 9 wherein said disk has an outer diameter of about 300 millimeters and wherein said web has a constant thickness of about 3 to 4 millimeters.

* * * * *